United States Patent [19]

Kikuchi et al.

[11] Patent Number: 4,713,092

[45] Date of Patent: Dec. 15, 1987

[54] ELECTROSTATIC PRECIPITATOR

[75] Inventors: Yoshikazu Kikuchi, Tokyo; Reiro Nakao, Kawaguchi, both of Japan

[73] Assignee: Corona Engineering Co., Ltd., Japan

[21] Appl. No.: 16,992

[22] Filed: Feb. 19, 1987

Related U.S. Application Data

[63] Continuation of Ser. No. 765,036, Aug. 12, 1985, abandoned.

[30] Foreign Application Priority Data

Aug. 14, 1984 [JP] Japan ..... 59-168892

[51] Int. Cl.[4] ..... B03C 3/12; B03C 3/14; B03C 3/45

[52] U.S. Cl. ..... 55/130; 55/138; 55/154; 55/397; 55/440

[58] Field of Search ..... 55/124, 127, 128, 130, 55/138, 143, 145, 154, 156, 137, 394, 397, 440

[56] References Cited

U.S. PATENT DOCUMENTS

| | | | |
|---|---|---|---|
| 1,343,285 | 6/1920 | Schmidt | 55/137 X |
| 1,956,591 | 5/1934 | Gies | 55/130 |
| 2,357,354 | 9/1944 | Penney | 55/138 X |
| 2,579,441 | 12/1951 | Palmer | 55/138 X |
| 2,813,595 | 11/1957 | Fields | 55/137 |
| 3,338,035 | 8/1967 | Dinkelacker | 55/440 |
| 3,365,858 | 1/1968 | Penney | 55/128 X |
| 4,284,420 | 8/1981 | Borysiak | 55/138 X |

FOREIGN PATENT DOCUMENTS

| | | | |
|---|---|---|---|
| 464308 | 8/1928 | Fed. Rep. of Germany | 55/130 |
| 464858 | 12/1928 | Fed. Rep. of Germany | 55/130 |
| 475436 | 11/1930 | Fed. Rep. of Germany | 55/394 |
| 994538 | 11/1951 | France | 55/130 |
| 404495 | 1/1934 | United Kingdom | 55/397 |
| 950565 | 2/1964 | United Kingdom | 55/154 |

*Primary Examiner*—Kathleen J. Prunner

*Attorney, Agent, or Firm*—Thomas S. MacDonald; Alan H. MacPherson; Paul J. Winters

[57] ABSTRACT

An electrostatic precipitator includes charging, inertia and collection sections, which are arranged in the order mentioned along the direction of gas flow containing therein particles to be removed. The charging section includes a parallel electrode and a discharging electrode located between the parallel plates, and, thus, the particles floating in the gas passing through the charging section become charged and partly agglomerated. The inertia section includes a deflector plate arranged at a predetermined angle thereby causing the gas flow to change its course of action locally to have the particles impinge on the deflector plate due to inertia. The collection section includes a trough which is formed continuous with the deflector plate with its mouth opened against the gas flow.

10 Claims, 17 Drawing Figures

ELECTROSTATIC PRECIPITATOR

This application is a continuation of application Ser. No. 765,036, filed Aug. 12, 1985, now abandoned.

BACKGROUND OF THE INVENTION

1. Field of the Invention

This invention generally relates to a dust collector for collecting air-born dust in the form of liquid droplets and solid particles, and, in particular, to an electrostatic precipitator for use in collecting dust and mist in various coal-fired boilers, cement plants, iron manufacturing plants, metal refining plants, chemical plants and incinerators.

2. Description of the Prior Art

An electrostatic precipitator is well known in the art for removing dust and other particles from a gas by charging the particles and having them collected on collector plates. Typically, such an electrostatic precipitator includes a pair of parallel plates and a corona wire located at the center between the parallel plates, in which a high voltage is applied to the corona wire with the parallel plates being grounded, and a gas containing dust is passed through the pair of parallel plates whereby the dust becomes charged and collected onto both of the parallel plates. Another typical form of electrostatic precipitator includes a cylindrical tube and a corona wire extending along the longitudinal center of the tube, in which a high voltage is applied to the corona wire with the tube being grounded, and a gas containing dust is passed through the tube whereby the dust becomes charged and collected onto the tube. Such an electrostatic precipitator is quite efficient in collection of dust and mist, but since the collection site is generally flat with respect to the flow direction of gas, the collected dust tends to be reentrained into the gas flow, thereby decreasing the collection efficiency. Interestingly, larger particles are easier to collect, but larger particles are also easier to reentrain. It should also be noted that the chances of occurrence of such reentrainment are higher if the gas flow velocity is higher.

It is also known to utilize the inertia effect to remove droplets and particles from a gas, in which case a deflector plate is typically provided to change the course of gas flow thereby causing particles having mass to deviate from the streamline of gas flow to hit the deflector plate to be collected thereon. Such a dust collector is typically shown in Japanese Patent Post-Examination Pub. No. 49-36186. It is to be noted, however, that such a dust collector relying on the inertia effect of each particle is efficient in collecting relatively larger-sized particles, e.g., 10 microns or more in diameter, but its collection efficiency significantly drops for smaller-sized particles.

In view of the recent trend for making regulations against air pollution more stringent, it is desired to provide an improved device for collecting dust and mist at high efficiency.

SUMMARY OF THE INVENTION

In accordance with the principle of the present invention, there is provided a device for removing particles from a gas, which generally includes a charging section, an inertia section and a collection section arranged in the order mentioned with respect to the direction of gas flow. The charging section preferably includes a pair of parallel plates spaced apart from each other and corona emitting means located between the parallel plates, in which a high voltage is applied to the corona emitting means with the parallel plates being grounded so that corona ions of predetermined polarity are emitted and directed toward the parallel plates according to the electric field created between the corona emitting means and the parallel plates. Thus, the particles in the gas flowing between the parallel plates become charged and the charged particles tend to move toward the parallel plates, wherein the particles also become agglomerated. The charged particles are partly collected on the parallel plates but the remaining particles remain floating in the gas flowing downstream.

The inertia section includes a deflector plate which is disposed inclined with respect to the flowing gas through the charging section and which has its upstream end connected to the downstream end of one of the parallel plates of the charging section. The gas flowing out of the charging section is deflected by this deflector plate and the particles, agglomerated at least partly by the charging section, come to impinge on the deflector plate due to inertia. The larger the particles, the higher the chance of hitting the deflector plate. The particles collected on the parallel plates may be reentrained into the gas flow, and, in this case, the reentrained particles are most likely to be agglomerates of particles which are larger in size and thus most likely to hit the deflector plate. Thus, the particles are again collected on the deflector plate mainly due to inertia.

The collector section includes a collector trough which has a generally inverted C-shaped cross section. The collector trough includes a pair of parallel plates and an end plate connecting both ends of the parallel plates thereby defining the shape of inverted "C". One ot the parallel plates is connected to the downstream end of the deflector plate of the inertia section. As a result, the particles, agglomerated or not, are first collected on the deflector plate and then move along the deflector plate to be collected into the collector trough. Since the collector trough extends vertically with its mouth directed upstream, the particles collected within the collector trough move downward as guided by the collector trough due to gravity. There is provided a bottom collection chamber at the bottom end of the collection trough and outside the flowing gas, so that the collected particles moving downward as guided by the collection trough are finally collected into the bottom collection chamber.

It is therefore a primary object of the present invention to obviate the disadvantages of the prior art as described above and to provide an improved device for collecting particles, liquid or solid.

Another object of the present invention is to provide an improved device for collecting particles high in collection efficiency and reliable in operation.

A further object of the present invention is to provide an improved device capable of collecting fine particles at high efficiency.

Other objects, advantages and novel features of the present invention will become apparent from the following description of the invention when considered in conjunction with the accompanying drawings.

DESCRIPTION OF THE PREFERRED EMBODIMENTS

Figure 1A:
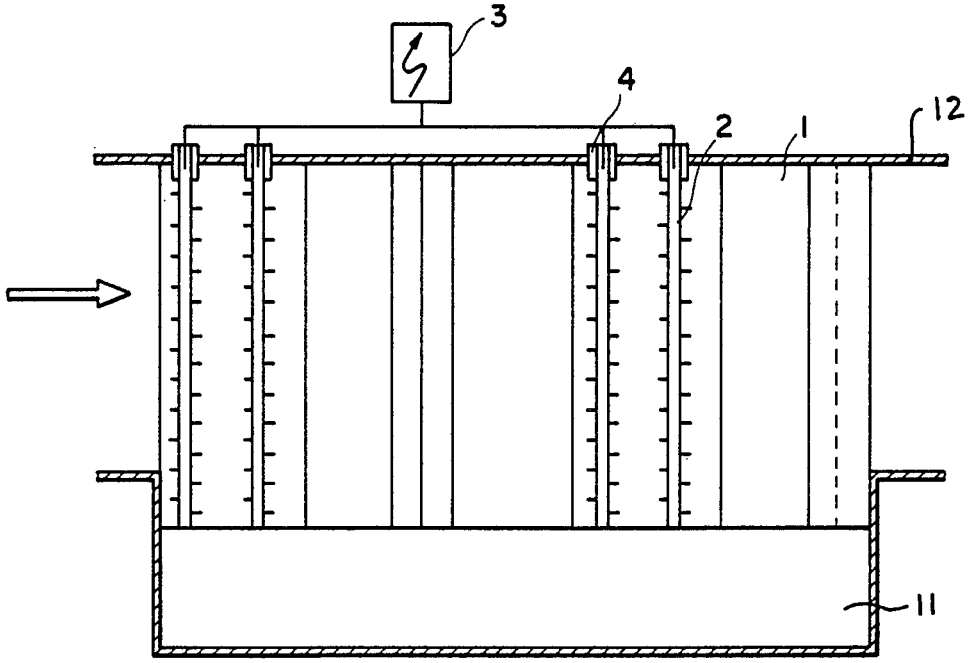
FIG. 1*a* is a schematic, longitudinal, cross-sectional view showing an electrostatic precipitator constructed in accordance with one embodiment of the present invention.
Figure 1B:
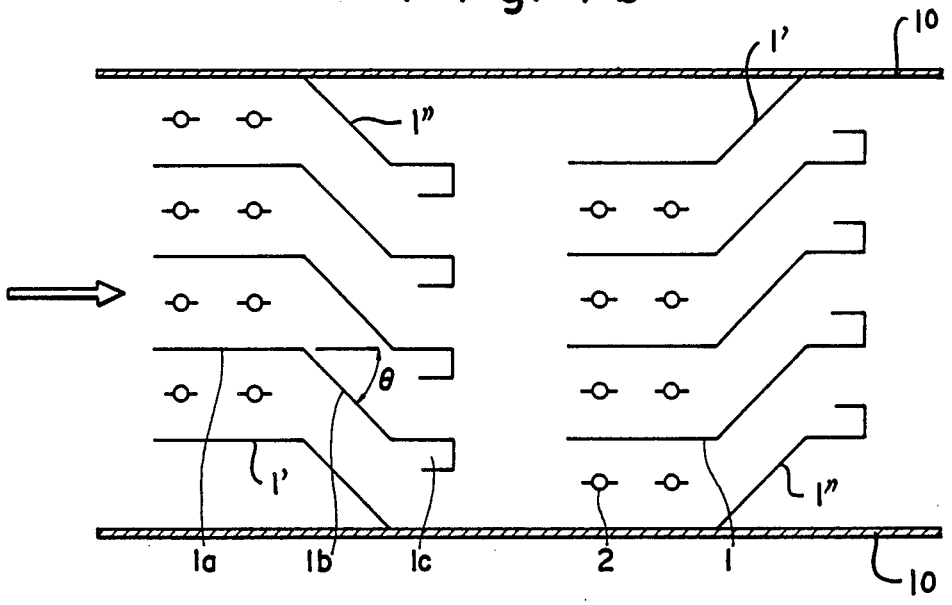
FIG. 1*b* is a schematic, plan, cross-sectional view showing the structure shown in FIG. 1*a*.

Referring now to FIGS. 1*a* and 1*b*, there is shown a device for collecting air-borne particles, such as dust and mist. As shown, the device includes a pair of flat side plates 10, 10 which are spaced apart from each other over a predetermined distance, a plurality of particularly shaped collector electrode plates 1 which are arranged between the pair of side plates 10, 10 as spaced apart from one another at a predetermined pitch in the form of an array, and a plurality of discharging electrodes 2 which are disposed between the respective two adjacent collector electrode plates 1. It is to be noted that all of the collector electrode plates 1 are identically shaped excepting those 1' and 1" on both sides of the array. That is, as best shown in FIG. 1*b*, each of the collector electrode plates 1 has a parallel section 1*a*, an inclined section 1*b* and a trough section 1*c*.

The parallel section 1*a* is arranged to be in parallel with the side plates 10. The gas flow direction is as indicated by the arrow, and the plurality of discharging electrodes 2 are arranged as spaced apart from one another in the gas flow direction at a predetermined pitch between the respective two adjacent parallel sections 1, 1. Thus, in effect, the parallel section 1a defines a charging section where the particles floating in the gas flowing through this section become charged to a predetermined polarity by the corona ions emitted from the discharging electrode. It is to be noted that the particles thus charged are partly collected on the parallel sections 1*a* and are agglomerated partly thereon and partly in the gas.

The inclined section 1*b* is formed continuously from the parallel section 1*a* and provided to form an angle $\theta$ with the parallel section 1*a*. The inclined section 1*b* extends at the angle $\theta$ from the downstream end of the parallel section 1*a* and in the embodiment shown in FIGS. 1*a* and 1*b* extends generally across the flow channel defined between the two adjacent parallel sections 1*a*, so that the gas flowing between the adjacent parallel sections 1*a* becomes deflected by the inclined section 1*b*. Thus, the inclined section 1*b* defines an inertia section which serves as a deflector for the flowing gas. Because of this deflection of the flowing gas, the particles floating in the gas impact on the inclined section 1*b* due to inertia to be collected thereon, and the particles collected on the inclined section move therealong toward the downstream direction mainly due to the driving force applied by the flowing gas. Preferably, the angle $\theta$ is set to range from 40° to 50°.

Also provided as continuous from the inclined section 1*b* is the trough section 1*c* which is in the shape of a trough extending vertically with its opening directed opposite to the gas flowing direction. Thus, the particles collected on the inclined section 1*b* and caused to move downstream therealong are finally captured as collected in the vertical trough section 1*c*. As the particles accumulate in the trough section 1*c*, they drop into a bottom collection chamber 11 due to gravity as guided by the trough section 1*c*. It is to be noted that, in such an arrangement, the space defined by the trough section 1*c* is somewhat negative in pressure compared with the flow channel defined between the two adjacent collection electrode plates 1, 1 so that the particles either moving along the inclined section 1*b* or floating in the flowing gas tend to be collected into the trough section 1*c*, which is particularly advantageous from the viewpoint of collection efficiency. Besides, the trough section 1*c* is advantageous in preventing the collected particles from being reentrained into the flowing gas. In the embodiment illustrated in FIGS. 1*a* and 1*b*, the trough section 1*c* has a cross section which is generally in the shape of inverted "C" and thus includes a pair of opposite side plates and an end plate which adjoins the pair of opposite side plates. The side plate of the trough section which extends continuously from the inclined section 1*b* and parallel with the original flow direction is longer than the other side plate thereby forming the opening of the trough section 1*c* flush with the inclined section 1*b*.

The end collection electrode plates 1' and 1" disposed on both ends of the array of the collection electrode plates are somewhat different in shape. That is, the end collection electrode plate 1' only includes the parallel sectin 1*a* and the inclined section 1*b*; on the other hand, the other end collection electrode plate 1" only includes the inclined section 1b and the trough section 1*c*. It should be noted, however, that the end collection electrode plates 1' and 1" are basically the same in structure as the intermediate plates 1 excepting that they are fragmentary because they are located at the end of the array.

Also provided as shown in FIG. 1*a* is a high voltage power supply 3 which is electrically connected to each of the discharging electrodes 2 so as to maintain the discharging electrodes 2 at a high potential, preferably of negative polarity. Although not shown particularly, it should be understood that the collection electrode plates 1, 1' and 1" and the side plates 10, 10 are all connected to ground. In the embodiment illustrated in FIGS. 1*a* and 1*b*, use is made of a needle-pointed discharging rod 2 as a discharging electrode for emitting corona ions and there is provided a holder 4 comprised of an electrically insulating material for holding the corresponding rod 2 in position. The holder 4 is securely mounted in a top plate 12 which is preferably formed from a metal plate so as to be connected to ground.

In operation, the high voltage power supply 3 is activated to apply a desired high voltage to each of the discharging electrodes 2 while the remaining structure, including the collection electrode plates 1 and the side and top cover plates 10 and 12 is connected to ground. A gas containing therein floating particles, liquid or solid, is then passed through the device as indicated by the arrow. As the gas flows through the channels at the charging section 1*a*, the particles floating in the gas become charged negatively if the high voltage applied to the discharging electrodes 2 is, in fact, negative in polarity. However, since the particles floating in the gas in natural state are typically charged in both polarities in various degrees, the particles thus charged are partly agglomerated to form larger-sized clumps and some of the well charged particles are collected onto the parallel plate sections 1a where wall agglomeration also takes place to form larger-sized clumps on the site of the parallel sections 1*a*.

The particles collected on the parallel plate sections 1*a* also tend to move downstream due to the motion of the flowing gas and thus they crawl along the wall surface toward the downstream direction. As the gas flows further downstream, it enters the inertia section where the inclined plate section 1*b* serving as a deflector is provided. Thus, the particles, agglomerated or not, remaining in the gas are collected onto the inclined plate sections 1*b* due to inertia as the gas is deflected from the original flowing direction. The particles thus collected onto the inclined plate sections 1*b* then move therealong in the downstream direction to be finally collected into the trough section 1*c*. Since the opening of the trough section 1*c* is directed opposite to the flowing gas stream, the particles still in the gas may also be directly collected into the trough section 1*c* mainly due to inertia. In this manner, since the present device relies on the inertia effect of particles, it is preferable to set the gas flow velocity at a relatively high level ranging from 3 to 10 m/s.

In the structure shown in FIGS. 1*a* and 1*b*, it should also be noted that there are provided two arrays of collection electrode plates, as best shown in FIG. 1*b*. The upstream and downstream arrays of collection electrode plates are arranged such that their orientation of collection electrode plates 1 are reversed. In other words, the collection electrode plates 1 of the upstream array are arranged such that their inclined plate sections 1*b* extend toward the bottom of the figure with respect to the gas flowing direction when viewed from top; on the other hand, the collection electrode plates 1 of the downstream array are arranged such that their inclined plate sections 1*b* extend toward the top of the figure with respect to the gas flowing direction when viewed from top. Such a tandem structure with reversed arrangement of collection electrode plates 1 is particularly advantageous. It is to be noted, however, that the present invention should not be limited only to this, and a multi-stage structure having three or more stages, reversed or non-reversed arrangement, or a single stage structure is also possible.

Figure 2:
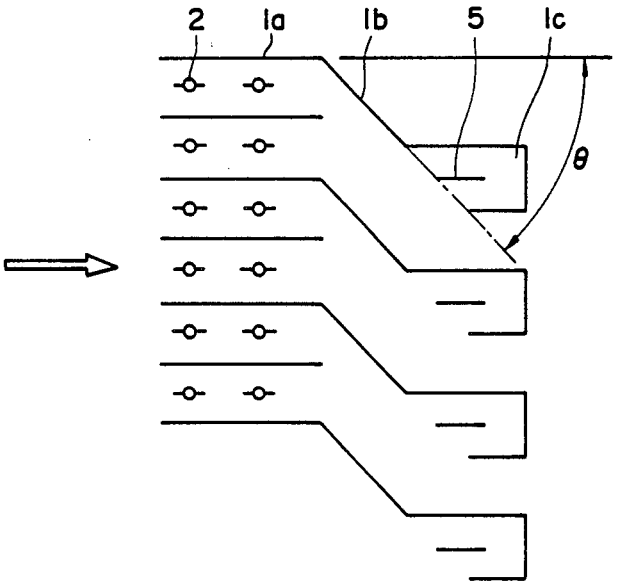
FIGS. 2 and 3 are schematic, plan views showing other embodiments each having a different overall arrangement of the present invention.

FIG. 2 shows another embodiment of the present invention which is basically the same in structure as the previously described embodiment as far as the provision of three sections: charging, inertia and collection is concerned. In the present embodiment, however, the inclined section 1*b* is not provided for each of the parallel sections 1*a*, but it is provided for every other parallel section 1*a*. Furthermore, the trough section 1*c* is made somewhat larger in size with the additional provision of a center plate 5 located approximately at the center of the trough section 1*c* and extending in parallel with the longitudinal direction of the overall device. In this case also, the center plate 5 is so provided with its upstream end located at a line which is an extension of the inclined section 1*b*.

Figure 3:
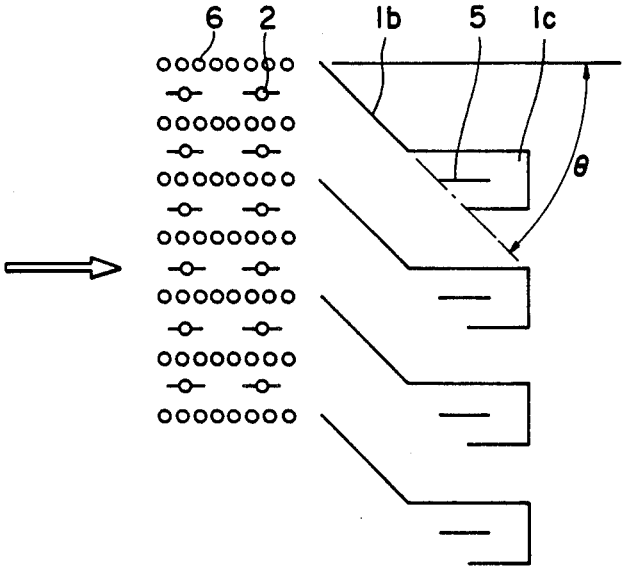

FIG. 3 shows a further embodiment of the present invention which is similar in structure to the device shown in FIG. 2 in many respects. The device of FIG. 3 differs from that of FIG. 2 in that the parallel plate sections 1a are substituted by rows of pipes. This is easier to manufacture as compared with the device shown in FIG. 2.

Figure 4A:
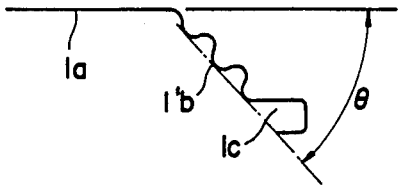
FIGS. 4*a* through 4*e* are schematic illustrations showing various modifications in the inertia and/or collection sections in the electrostatic precipitator of the present invention.
Figure 4B:
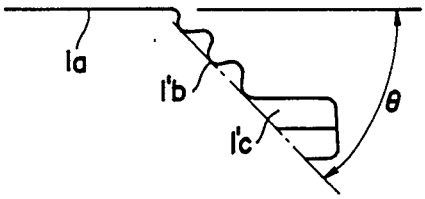
Figure 4C:
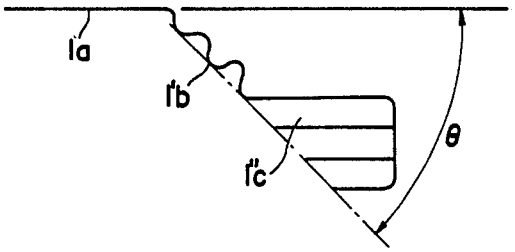
Figure 4D:
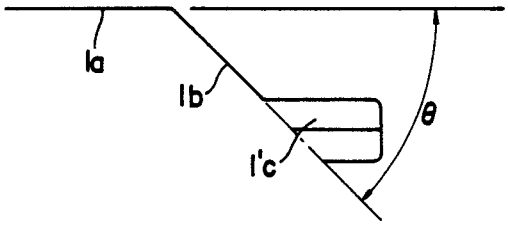
Figure 4E:
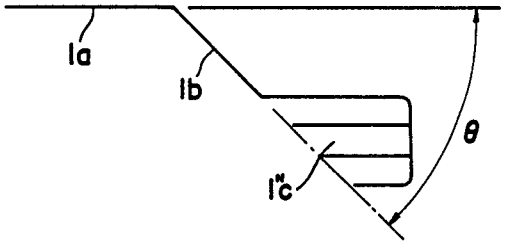

FIGS. 4*a* through 4*e* show various modifications of the collection electrode plate 1 for use in the present invention. For example, in the case of FIG. 4*a*, there is provided a wavy inclined section 1'*b* instead of the straight inclined section 1*b* in each of the previously described embodiments. FIG. 4*b* shows the structure which is similar to that of FIG. 4*a* but has a modified trough section 1'*c* which has an intermediate plate with its downstream end fixedly attached to the end plate of the trough section 1'*c*. FIG. 4*c* shows a further modification having a modified trough section 1''*c* in which two intermediate plates are provided. On the other hand, FIG. 4*d* shows another collection electrode plate including the parallel section 1*a*, straight inclined section 1*b* and modified trough section 1'*c* having an intermediate plate whose downstream end is fixedly attached to the end plate of the trough section 1'*c*. FIG. 4*e* shows a modification of the structure shown in FIG. 4*d* with additional provision of an intermediate plate.

Figure 5A:
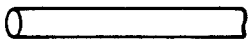
FIGS. 5*a* through 5*g* are perspective views showing various discharging electrodes applicable to the present invention.
Figure 5B:
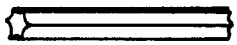
Figure 5C:
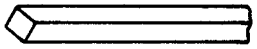
Figure 5D:
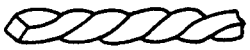
Figure 5E:
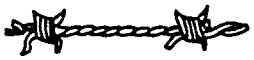
Figure 5F:
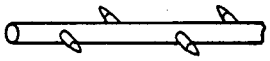
Figure 5G:
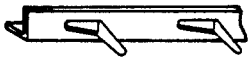

FIGS. 5*a* through 5*g* show various discharging electrodes which may be applied to the present invention. FIG. 5*a* shows a discharging wire or rod having a circular cross section. FIGS. 5*b* and 5*c* shows discharging rods having star-shaped and rectangular cross sections, respectively. FIG. 5*d* shows a twisted rectangular discharging wire and FIG. 5*e* shows a barbed wire for use as a discharging wire. FIG. 5*f* shows a rod planted with a plurality of needles, which was used in the previously described first embodiment. FIG. 5*g* shows a discharging electrode formed by an angle member which is partly cut to define pointed projections.

Figure 6:
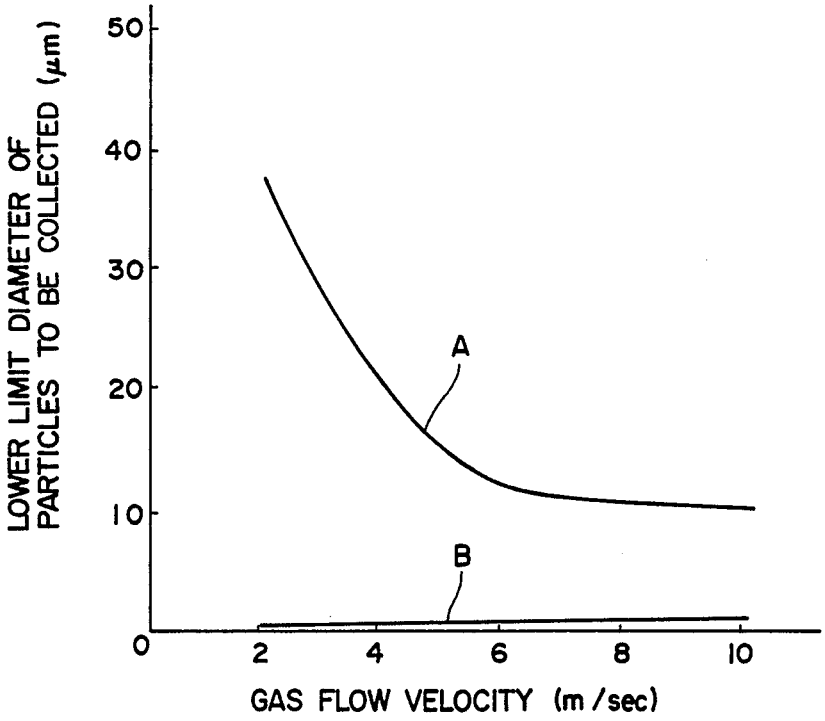
FIG. 6 is a graph showing the relation between the velocity of the gas flowing through the precipitator and the lower limit diameter of particles to be collected.

FIG. 6 is a graph showing the experimental results obtained by the present invention and the prior art. The experiments were conducted using the air containing mist at the density of 1,000 $Kg/m^3$ of water at normal temperature and pressure. Curve A is the result obtained by the prior art structure and curve B indicates the results obtained by the present invention. It may be easily seen that the present invention is remarkably effective in collecting fine particles over a wide range of gas flow velocity.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A device for collecting particles floating in a gas, comprising:

a flow channel for flowing said gas in a predetermined direction;

corona charging means for charging at least partly said particles floating in said gas flowing through said channel thereby causing said particles to be agglomerated at least partly, said charging means being located inside of said flow channel and including at least a pair of parallel electrode means spaced apart from each other over a predetermined distance and each arranged in parallel with said predetermined direction and at least one corona electrode means disposed between said pair of parallel electrode means;

deflecting means disposed downstream of said corona charging means for deflecting said gas such that said gas flows generally in a direction other than said predetermined direction thereby causing particles in said deflected gas to impinge on said deflecting means due at least partly to inertia; and collecting means disposed downstream of and formed continuously with said deflecting means to define a local negative pressure region, said collecting means having in a horizontal plan view a generally inverted C-shaped cross section whose upstream end is connected to said deflecting means and which is all located at a downstream side with respect to an imaginary line defined as a trailing extension of said deflecting means, for collecting at least said particles moving along said deflecting means, said collecting means guiding said particles thus collected to be transported by force of gravity to a desired position without being reentrained in the flowing gas.

2. The device of claim 1 wherein a high voltage of predetermined polarity is applied to said corona electrode means and said parallel electrode means is connected to ground.

3. The device of claim 2 wherein said deflecting means includes at least one inclined plate which is disposed to form a predetermined angle with respect to said predetermined direction.

4. The device of claim 3 wherein said angle is set in a range from 40° to 50°.

5. The device of claim 3 wherein said inclined plate is wavy in shape.

6. The device of claim 3 wherein said collecting means includes a trough which is continuously formed with said inclined plate with its opening formed flush with the line of said inclined plate.

7. The device of claim 6 wherein said trough is provided with at least one intermediate plate generally housed therein.

8. The device of claim 7 wherein said intermediate plate has its upstream end located at a line which is an extension of said inclined plate.

9. The device of claim 1 wherein each of said pair of parallel electrode means includes a flat plate extending in parallel with said predetermined direction.

10. The device of claim 1 wherein each of said pair of parallel electrode means includes a plurality of vertical pipes arranged along a straight line extending in parallel with said predetermined direction.

* * * * *